United States Patent [19]

Solomon

[11] 4,438,668

[45] Mar. 27, 1984

[54] WRENCH

[76] Inventor: Yeheskel Solomon, Gush Etzion 3, Givatayim, Israel

[21] Appl. No.: 337,145

[22] Filed: Jan. 5, 1982

[30] Foreign Application Priority Data

Jan. 5, 1981 [IL] Israel ..... 61855

[51] Int. Cl.[3] ..... B25B 7/12

[52] U.S. Cl. ..... 81/352; 81/373; 269/239; 269/243

[58] Field of Search ..... 81/91 R, 91 A, 91 B, 81/91 C, 111–118, 346–348, 352–354, 373, 385–390, 395, 405; 269/239, 243, 256

[56] References Cited

U.S. PATENT DOCUMENTS 673,605 5/1901 Jacques ..... 269/256

1,157,540 10/1915 Hamphris ..... 81/117

*Primary Examiner*—James L. Jones, Jr.

*Attorney, Agent, or Firm*—Silverman, Cass & Singer, Ltd.

[57] ABSTRACT

A wrench includes two mutually movable jaws that are mounted by means of parallel linkages to a housing forming the handle. A rod is axially movable in the handle by means of an internally threaded sleeve extending into the bottom of the handle. The rod is connected at its top, by a pivotal link, to the top of the outer member of the parallel linkage. A locking member is pivotally attached to the housing and there is pivotally connected thereto, a wedge-shaped member that is adapted to engage a locking sleeve loosely mounted on the rod. The rotation of the threaded sleeve adjusts the distance between the jaws, while the engagement of the stop member with the locking sleeve prevents the movement of the jaws when they are in a working position.

4 Claims, 2 Drawing Figures

WRENCH

The present invention concerns wrenches of the kind which assure continuous parallelism of the jaws and their tight application to a work piece during use.

In my prior Israel patent No. 38172 a wrench is described and claimed, comprising two jaws each pivotally connected in a channel-like cover pivotally fixed to a handle housing, said jaws being likewise connected by an adjustable pivot to one end of L-shaped links, said links being pivotally attached in said covers and pivotally attached to a connecting member integral with a rod which is adapted to be axially moved relative said L-shaped links in said handle housing, a substantially semicylindrical wedge member being adapted to be pivoted within said handle housing by means of a link and lever handle to urge said rod into said housing and thereby to cause the L-shaped links and the jaws to approach each other and to be fixed in said position.

I have found that this wrench is expensive to produce since it has a number of complicated parts. Furthermore, it does not grip the workpiece in a fully tight grip, since the L-shaped link and the adjustable pivot permit a movement of the jaws.

The wrench according to the invention overcomes these drawbacks and comprises two mutually movable jaws, each mounted by means of a parallel linkage to a housing constituting the handle, a rod being axially movable in said handle by means of an internally threaded sleeve extending into the bottom end of the handle, said rod being connected at its top by a pivotal link to the top of the outer member of said parallel linkage, a locking lever being pivotally attached to said housing and having pivotally connected thereto a wedge-shaped member which is adapted to engage a locking sleeve loosely mounted on said rod, the rotation of said threaded sleeve adjusting the distance between the jaws, the engagement of said stop member with the locking sleeve preventing their movement when said jaws are in working position.

In a preferred embodiment of the invention one member of said parallel linkage is a channel shaped cover for the other links.

In still a further embodiment of the invention an auxiliary lever having an integral nose is provided and is adapted to engage an abutment on said stop member.

The invention is illustrated, by way of example only, in the accompanying drawings in which.

Figure 1:
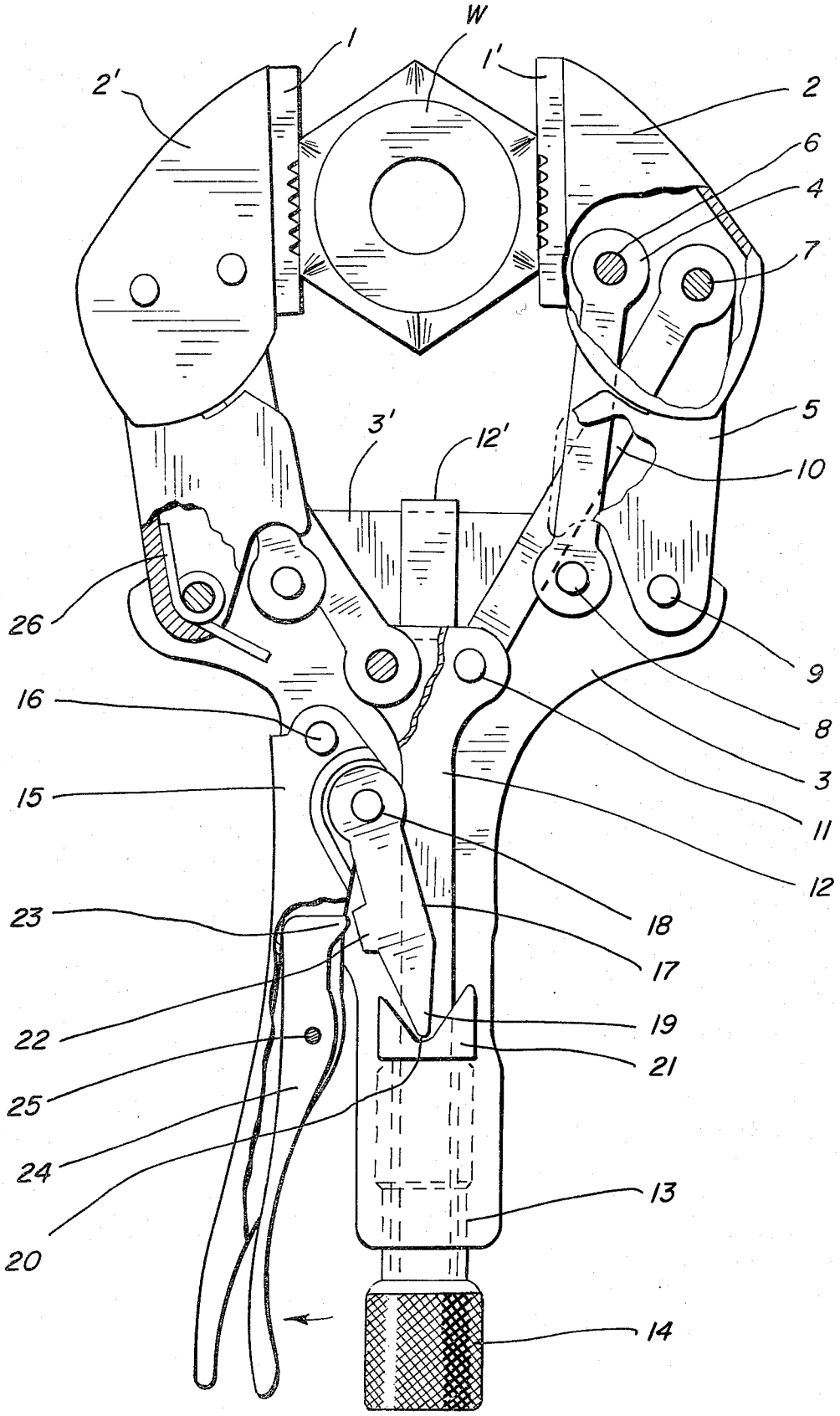
FIG. 1 shows an elevation of a wrench in working condition, parts being broken away for the sake of clarity.

The wrench according to the invention comprises two jaws 1,1' mounted on the sides of the hook-like cover, 2,2'. Said cover is attached by means of a parallel linkage to a housing 3, whose bottom part constitutes the handle of the wrench and which is made of heavy pressed sheet metal. The parallel linkage comprises one straight link 4 and a channel shaped link 5 attached by means of pivots 6,7 to the cover 2 at one end and at the other at pivots 8,9 to the top of said housing. Said channel 5 provides a cover for the link 4 and for a further straight link 10 which is pivotally attached to pivot 7 on the one hand and similarly to a pivot 11 provided near the top of a rod 12 axially movable within housing 3.

The axial movement of rod 12 is effected by means of an internally threaded sleeve 13 mounted in the bottom end of the handle and extending outwardly, said sleeve being rotatable in a fixed position and engaging the correspondingly threaded end of rod 12. The outer end of sleeve 13 is knurled for easier rotation at 14. At its top, rod 12 is extended by a cylindrical lug 12' which is guided in its axial movement in a channel 3' swaged in the wall of housing 3. It can be seen from FIGS. 1 and 2 that a rotation of sleeve 13 will cause an axial movement of rod 12 and thus push or pull link 10 as the case may be, whereby the jaws are brought towards of away from each other.

A locking lever 15 is pivotally mounted at 16 to housing 3. To said locking lever stop members 17 are pivotally mounted at 18, each stop member having a pointed end 19 which engages in diametrically opposed depressions 20 of a locking sleeve 21 loosely mounted on rod 12 above sleeve 13. The two stop members 17 are connected by a bridge which constitutes an abutment 22 against which a nose 23 of an auxiliary lever 24 pivotally mounted at 25 to locking lever 15 is adapted to abut.

Figure 2:
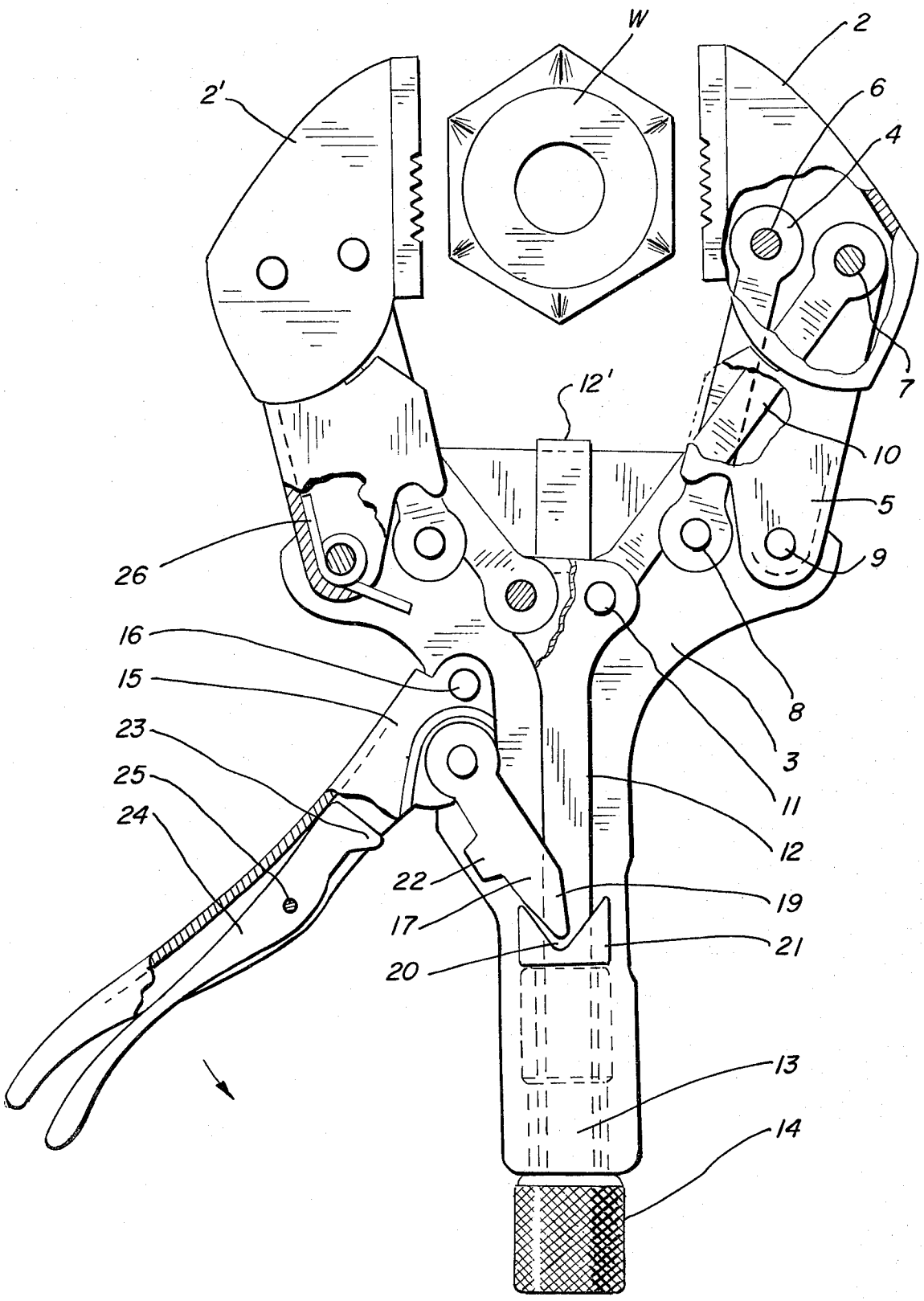
FIG. 2 shows a similar view of the same in non-working condition.

In the position shown in FIG. 2 a rotation of sleeve 13 will adjust the distance between the jaws 1,1'. In the present case a hexagonal workpiece W is shown. In order to lock the jaws onto workpiece W so that they cannot move relative thereto, locking lever 15 is depressed in the direction of the arrow shown in FIG. 2. This causes the part 21 to be tightly locked against sleeve 13 so that the latter can no longer be rotated and thereby move rod 12 together with links 10 and thus jaws 1,1'. In order to facilitate the unlocking of lever 15, auxiliary lever 24 is rotated in the direction of the arrow of FIG. 1, whereby wrench 17 is made immovable while member 15 can be opened and thus auxiliary lever 24 can likewise be pulled in the direction of the arrow together with lever 15. The opening of the jaws is aided by coil springs 26 which are wound around pivot 9, the end abutting on the one hand on the wall of link 5 and on the other on the wall of handle 3.

I claim:

1. A wrench comprising two mutually movable jaws, each mounted by means of a parallel linkage to a housing constituting the handle, a rod being axially movable in said handle by means of an internally threaded sleeve extending into the bottom end of the handle, said rod being connected at its top by a pivotal link to the top of the outer member of said parallel linkage, a locking lever being pivotally attached to said housing and having pivotally connected thereto a wedge-shaped stop member which is adapted to engage a locking sleeve loosely mounted on said rod, the rotation of said threaded sleeve adjusting the distance between the jaws, the engagement of said stop member with the locking sleeve preventing their movement when said jaws are in working position.

2. A wrench as claimed in claim 1, wherein a lug is attached to the top of said rod and is guided in a channel in the housing.

3. A wrench as claimed in claim 1, wherein one member of said parallel linkage is a channel shaped cover for the other links.

4. A wrench as claimed in claim 1, wherein an auxiliary lever having an integral nose is provided and is adapted to engage an abutment on said stop member.

* * * * *